United States Patent [19]

Marsh

[11] 4,049,449

[45] Sept. 20, 1977

[54] METHOD FOR FORMING AN ELECTROPHOTOGRAPHIC MEMBER

[75] Inventor: Dana G. Marsh, Rochester, N.Y.

[73] Assignee: Xerox Corporation, Stamford, Conn.

[21] Appl. No.: 754,132

[22] Filed: Dec. 22, 1976

[51] Int. Cl.[2] ..... G03Q 5/08

[52] U.S. Cl. ..... 96/1.5 R; 204/158 R; 204/158 HE; 544/1

[58] Field of Search ..... 96/1.5; 204/158 R, 158 HE; 260/241

[56] References Cited

U.S. PATENT DOCUMENTS

| | | | |
|---|---|---|---|
| 3,758,301 | 9/1973 | Gunther | 96/1.5 |
| 3,994,791 | 11/1976 | Chu et al. | 96/1.5 X |
| 4,007,100 | 2/1977 | Chu et al. | 96/1.5 X |

*Primary Examiner*—Roland E. Martin, Jr.

*Attorney, Agent, or Firm*—James J. Ralabate; James P. O'Sullivan; Gaetano D. Maccarone

[57] ABSTRACT

There is described a method for forming an electrophotographic imaging member wherein a selenium compound dispersed in an electrically insulating polymer matrix is photochemically or thermally decomposed and elemental selenium and a charge carrier transport compound are deposited within the binder matrix.

2 Claims, No Drawings

METHOD FOR FORMING AN ELECTROPHOTOGRAPHIC MEMBER

BACKGROUND OF THE INVENTION

The application generally relates to a method for forming an electrophotographic imaging member and, more particularly, to a method for forming an imaging member which includes a photoconductive layer comprising elemental selenium and a charge carrier transport material dispersed within an electrically insulating binder material.

The formation and development of images on an imaging member of photoconductive materials by electrostatic means is well known. The best known of the commercial processes, more commonly known as xerography, involves forming an electrostatic latent image on the imaging layer of an imaging member by first uniformly electrostatically charging the surface of the imaging layer in the dark and then exposing this electrostatically charged surface to a light and shadow image. The light struck areas of the imaging layer are thus rendered relatively conductive and the electrostatic charge selectively dissipated in these irradiated areas. After the photoconductor is exposed, the latent electrostatic image on this image bearing surface is rendered visible by development with a finely divided colored electroscopic powder material, known in the art as "toner". This toner will be principally attracted to those areas on the image bearing surface having a relative polarity opposite to the charge on the toner and thus form a visible powder image. The developed image can then be read or permanently affixed to the photoconductor in the event that the imaging layer is not to be reused. This latter practice is usually followed with respect to the binder-type photoconductive films where the photoconductive insulating layer is also an integral part of the finished copy.

In so-called "plain paper" copying systems, the latent image can be developed on the imaging surface of a reusable photoconductor or transferred to another surface, such as a sheet of paper, and thereafter developed. When the latent image is developed on the imaging surface of a reusable photoconductor, the developed image is subsequently transferred to another substrate and then permanently affixed thereto. Any one of a variety of well-known techniques can be used to permanently affix the toner image to the transfer sheet, including overcoating with transparent films and solvent or thermal fusion of the toner particles to the supportive substrate.

In the most popular of the xerographic systems the imaging member comprises a photoconductive insulating layer of amorphous selenium. There are also known in the art photoconductive layers wherein selenium and a charge carrier transport material capable of transporting at least one species of charge carrier are dispersed throughout an electrically insulating polymeric binder material.

Chu et al. have disclosed a method for forming such a member in U.S. Pat. No. 3,994,791. In this method an organoselenium precursor compound is dispersed in a polymeric binder matrix and the compound is decomposed thereby causing elemental selenium to be deposited throughout the matrix. According to the disclosed method the polymeric binder matrix may include or be made up of a charge carrier transport material which is capable of transporting at least one species of charge carrier.

In well-established technical fields such as xerography new techniques are proposed for the formation of known articles. The present invention is directed to a novel method for the formation of an electrophotographic imaging member.

SUMMARY OF THE INVENTION

It is therefore the object of this invention to provide a method for the formation of an electrophotographic imaging member.

It is another object of the invention to provide a method for the formation of an imaging member comprising a layer including selenium and a charge carrier transport material dispersed within an electrically insulating binder matrix.

It is a further object to provide such a method wherein an organoselenium compound is photochemically or thermally decomposed whereby elemental selenium and a charge carrier transport matrix capable of transporting at least one species of charge carrier are dispersed within an electrically insulating binder matrix.

BRIEF SUMMARY OF THE INVENTION

These and other objects and advantages are accomplished in accordance with the invention by forming a solid phase dispersion comprising an organoselenium compound which is represented by the formula

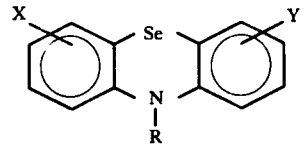

wherein

R has from 1 to about 20 carbon atoms and may be alkyl, aryl substituted alkyl, amino derivatives of alkyl and aryl substituted alkyl;

aryl, alkyl substituted aryl, amino substituted aryl, alkylamino substituted aryl, arylamino substituted aryl, alkylcarbonyl, arylcarbonyl and aminosubstituted derivatives of alkylcarbonyl and arylcarbonyl; and X and Y are independently selected from the group consisting of H and alkyl and perfluoroalkyl having from 1 to about 4 carbon atoms in an electrically insulating polymeric binder matrix.

A layer of the dispersion is formed on a conductive substrate and the dispersion is then exposed to appropriate electromagnetic radiation or thermal energy whereby the organoselenium compound is decomposed. Thus, elemental selenium and a carbazole derivative which is capable of transporting at least one species of charge carrier are deposited within the polymeric binder matrix.

DESCRIPTION OF THE PREFERRED EMBODIMENTS

The solid phase dispersion layer may be formed by any suitable method such as, for example, dissolving the organoselenium compound and the polymeric binder material in a common solvent such as, for example, tetrahydrofuran and depositing a layer of the solution on a suitable substrate followed by drying to drive off the excess solvent. The layer typically has an average thickness of from about 2 to about 25 microns. It is preferred to utilize a solvent which will not adversely affect the electrical properties of the final member to any substantial extent. Typically, the solution from which the layer is deposited includes from about 5 to about 20% weight/volume of polymeric binder and from about 10 to about 30% weight/volume of the organoselenium compound. The substrate may comprise any appropriate conductive material.

Any suitable organoselenium compound having the structural formula described above may be used according to the invention. The compounds undergo decomposition to elemental selenium and a carbazole derivative in response to thermal energy or electromagnetic radiation which corresponds to their absorption spectrum. Typical suitable organoselenium compounds include, for example, 10-acetylphenoselenazine, 10-[2-(diethylamino)ethyl]-2-(trifluoromethyl)-phenoselenazine, 10-[3-(dimethylamino)propyl]-phenoselenazine, 10-[3-(benzylmethylamino)propyl]-phenoselenazine, 10-(3-dimethylaminopropyl)-1-methyl-phenoselenazine, 10-methylphenoselenazine, 10-benzylphenoselenazine, 10-benzoylphenoselenazine, 10-ethylphenoselenazine, N-isopropylphenoselenazine, and N-phenylselenazine.

Any suitable film forming electrically insulating polymeric binder material may be used in the solid phase dispersion. Typical suitable binder materials include polycarbonates, polyvinylchlorides, polyesters, polyurethanes, polysiloxanes, copolymers, blends and mixtures thereof.

The solid phase dispersion layer is subjected to thermal energy or electromagnetic radiation within the absorption spectrum of the organoselenium compound to decompose the latter and deposit elemental selenium and a carbazole derivative within the matrix. At least a substantial portion and preferably substantially all of the organoselenium compound present in the layer should be decomposed. Hence the layer should be subjected to sufficient thermal energy or electromagnetic radiation to accomplish this result. The amount of light intensity required to provide the desired result is dependent upon the extinction coefficient of the organoselenium compound and the amount present, i.e., enough light must be present to initially excite a sufficient portion of the organoselenium molecules; and the efficiency of the decomposition of the organoselenium compound to yield elemental selenium and a carbazole derivative. For example, if the efficiency or quantum yield is only 10%, then on average each organoselenium molecule would have to be excited 10 times before decomposition occurs.

The particle size of the elemental selenium deposited within the layer is to some extent dependent upon the amount of the organoselenium compound initially present, the nature of the binder material, the energy levels used to effect decomposition and subsequent heat treatment of the system. For example, heating films with dispersed submicron selenium particles can cause agglomeration or growth of the particles due to diffusion of the particles together to form average particle sizes that are micron size. Higher concentrations of the initially dispersed selenium particles formed during the decomposition reaction typically enhance such growth or aggregation.

The distribution of the elemental selenium particles within the layer can be affected in various ways. For example if the concentration of the organoselenium compound is very high and the absorption of light by the layer is high such that substantially all the light is absorbed in the region near the surface of the layer, the selenium particles deposited in the layer will be primarily near the exposed surface. On the other hand, if the precursor compound concentration is lower such that the light is uniformly absorbed throughout the layer, the selenium particles will be deposited substantially uniformly throughout the layer.

The polymer matrix may also affect the distribution of the selenium particles in the layer. Where the polymer matrix absorbs light in competition with the organoselenium compound and the polymer exhibits a high extinction coefficient for the wavelengths of light used, then most of the light absorption will occur near the exposed surface of the layer. The energy absorbed by the polymer near the layer surface may be transferred to the precursor compound present in that area if the energy levels are appropriate resulting in a decomposition of the precursor particles near the layer surface. Where the polymer does not absorb the light used for exposure another material which does efficiently absorb the light can be incorporated in the layer to transfer energy to the precursor compound. Depending upon the concentration of the light absorbing additive, the selenium particles may be deposited primarily near the surface of the layer or substantially throughout the layer.

The electrophotographic imaging member formed according to the method of the invention may be utilized to form reproductions of original objects according to the well known xerographic method. The member is electrostatically charged, exposed to an imagewise pattern of activating electromagnetic radiation to form an electrostatic latent image and then contacted with a developer material to form a visible image which is typically transferred to a permanent receiver member and fixed thereto.

What is claimed is:

1. A method for preparing an electrophotographic imaging member comprising the steps of:

a. providing a layer of a solid phase dispersion on a conductive substrate, said dispersion comprising an organoselenium compound which is represented by the structural formula

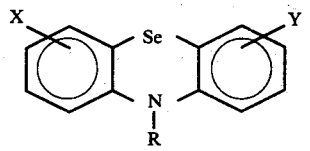

wherein

R has from 1 to about 20 carbon atoms and may be alkyl, aryl substituted alkyl, amino derivatives of alkyl and aryl substituted alkyl;

aryl, alkyl substituted aryl, amino substituted aryl, alkylamino substituted aryl, arylamino substituted aryl, alkylcarbonyl, arylcarbonyl, and aminosubstituted derivatives of alkylcarbonyl and arylcarbonyl; and X and Y are independently selected from the group consisting of H and alkyl and perfluoroalkyl having from 1 to about 4 carbon atoms in an electrically insulating polymeric binder matrix; and b. subjecting said layer to sufficient thermal energy or electromagnetic radiation to which said organoselenium compound is responsive to decompose at least a substantial amount of said organoselenium compound whereby elemental selenium and a carbazole derivative are deposited within said layer.

2. The method as defined in claim 1 wherein said solid phase dispersion layer has a thickness of from about 2 to about 25 microns.

* * * * *